United States Patent [19]

Lewis

[11] 4,270,794

[45] Jun. 2, 1981

[54] RETRACTABLE SEAT STRUCTURE

[76] Inventor: Dale E. Lewis, 328 E. Canal, Brookfield, Mo. 64628

[21] Appl. No.: 70,140

[22] Filed: Aug. 27, 1979

[51] Int. Cl.[3] ..... A47C 9/06

[52] U.S. Cl. ..... 297/14; 5/9 R; 297/333

[58] Field of Search ..... 297/14, 333; 5/9 R, 5/10 R; 312/313; 108/38

[56] References Cited

U.S. PATENT DOCUMENTS

| | | | |
|---|---|---|---|
| 945,208 | 1/1910 | Arter | 297/14 |
| 1,132,004 | 3/1915 | Freise | 297/14 |
| 1,465,529 | 8/1923 | Rumbaugh et al. | 297/14 |
| 1,642,125 | 9/1927 | Nelson | 297/14 |
| 1,668,386 | 5/1928 | Talbot | 297/14 |
| 2,714,920 | 8/1955 | Hancock | 297/14 |
| 3,762,764 | 10/1973 | McJunkin | 297/14 |
| 3,873,151 | 3/1975 | Morris et al. | 297/14 |
| 3,981,552 | 9/1976 | Karashima | 312/313 X |
| 4,009,903 | 3/1977 | Manspeaker | 297/14 |
| 4,087,127 | 5/1978 | Lotta | 297/14 |

FOREIGN PATENT DOCUMENTS

| | | | |
|---|---|---|---|
| 754409 | 8/1933 | France | 297/333 |
| 1115292 | 12/1955 | France | 297/333 |
| 2237411 | 2/1975 | France | 297/333 |
| 291547 | 6/1953 | Switzerland | 297/333 |
| 18694 | of 1901 | United Kingdom | 297/333 |

*Primary Examiner*—James T. McCall

*Attorney, Agent, or Firm*—Fishburn, Gold & Litman

[57] ABSTRACT

A retractable seat structure for movement between an open, extended position and a foldable, retracted position has a frame for mounting within a wall and a seat assembly foldably mounted relative to the frame. An elongate pivot member such as a rod extends across the frame and is secured to opposite frame end members. The seat assembly contains an interior panel member and has brackets secured to opposite rear corner portions of the panel member in order to suspend the seat panel member from the rod for up and down folding movement with the panel member rotating relative to the rod. A resilient member such as a coil spring is sleeved on the rod and has one end nonrotatably connected to the rod and another end extending laterally outward and secured to the seat panel member. The coil spring is of a resilient strength relative to the weight of the seat assembly whereby the seat assembly, when folded upwardly in a retracted position, remains in the retracted position and, when swung downwardly into the extended position, remains in the extended position. A stop is secured to the frame and is operable to engage the seat assembly and limit downward swinging movement thereof.

4 Claims, 4 Drawing Figures

RETRACTABLE SEAT STRUCTURE

This invention relates to folding seat structures and particularly to such structures which can be swung outwardly from a wall and retracted into the wall as desired.

Available space for seating along corridors, entrance ways, waiting rooms, and the like is often scarce and it is frequently desirable to have seating available should the need arise therefor. However, because of the lack of available room, relatively permanent and bulky seating structures such as benches, sofas, chairs and the like are often unsuitable. In these and many other instances, it is desirable to provide such hallways, corridors, entranceways and the like with a retractable seat structure which folds into a wall when not in use and swings out of the wall or extends as necessary for use.

Retractable seat structures which fold into a wall are known in the art however, most are unduly complicated, heavy, cumbersome and generally unsuited for normal residential use.

In view of the above, the principal objects of the present invention are: to provide a retractable seat structure having a minimal number of moving parts; to provide such a seat structure employing a frame therearound which easily fits between wall frame members of typical residential construction; to provide such a seat structure which is easily operated for extension and retraction; to provide such a seat structure employing a resilient means to maintain the seat panel thereof in a selected up or down position; to provide such a seat structure which is of pleasing design and can be coordinated with building interior colors to visually blend with the interior wall of the building whereby the seat structure is not particularly noticeable; and to provide such a seat structure which is relatively inexpensive, easily used in residential construction, of pleasing ornamental appearance, highly reliable in use and well adapted for its intended purpose.

Other objects and advantages of this invention will become apparent from the following description taken in connection with the accompanying drawings wherein is set forth by way of illustration and example, a certain embodiment of this invention.

Figure 1:
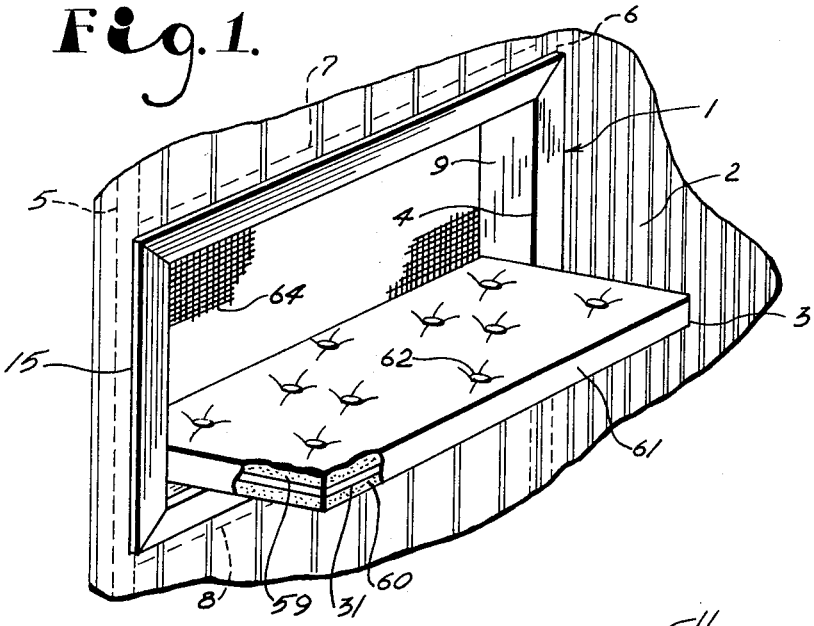
FIG. 1 is a perspective view illustrating a portion of a building wall and having a retractable seat structure mounted therein embodying the present invention and shown in an extended position.

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates a retractable seat structure embodying the present invention and mounted in a building wall 2. The retractable seat structure 1 includes a seat assembly 3 which swings between an open, extended position, FIG. 1 and a folded, retracted position, FIG. 3. The seat assembly 3 folds into a frame 4 and is pivotally mounted thereto, as described below, for said folding movement. Resilient means are engaged with means for pivoting and the seat assembly 3 and operate in coordination with the weight of the seat assembly 3 to maintain the seat assembly in a retracted position, when selected and in a extended position, when selected. A stop member is secured to the frame 4 and is operable to engage the seat assembly 3 and limit downward swinging movement into a position whereby the seat assembly 3 extends generally perpendicular to the wall 2, FIG. 1.

In the illustrated example, the building wall 2 is of frame construction and contains an interior structure of studs and cross members, such as of 2×4's and the like which form spaced studs 5 and 6 with upper and lower cross members 7 and 8 extending therebetween and providing an opening for receipt of the frame 4 of the seat structure 1, such as an opening is provided for a window or the like in typical frame construction.

The frame 4 is adapted for receipt and mounting within the wall 2 and has spaced upright end members 9 and 10 and upper and lower members 11 and 12. The frame members 9, 10, 11 and 12 are preferably adapted to fit within the building wall 2 and, in the illustrated example, are of framing lumber such as 1×4's to accord with the width of the studs and cross members 5, 6, 7 and 8. The end members 9 and 10 and upper and lower members 11 and 12 are secured together, such as by nails or the like to form a rectangular structure with front and rear marginal edges or surfaces 13 and 14. Decorative fascia members 15 extend around the front margin 13 of the frame 1 to provide an ornamental appearance therefor similar to that of a conventional picture frame with corner joints preferably suitably mitered and connected by fasteners or the like.

Pivot means for effecting folding or swinging movement of the seat assembly 3 are connected to the frame 4 and in the illustrated example, an elongate rod member 18 extends across the frame 4 and has opposite end portions 19 and 20 secured to the spaced end members 9 and 10 and positioned in spaced, parallel relationship to the lower member 12. The end portions 19 and 20 can be secured to the end members 9 and 10 by various means and in the illustrated example, the end portions 19 and 20 are threaded, extend through the end members 9 and 10 and are threadably engaged in receptacles with respective fittings 21 and 22 having flanges 23 secured to outer surfaces of the respective end members 9 and 10 as by fasteners or the like.

Connecting means secure the seat assembly 3 to the pivot means and in the illustrated example, spaced seat support brackets 26 and 27 are provided which respectively include arm portions 28 and flange portions 29. Apertures 30 extend through the arm portions 28 and receive the rod member 18 therethrough whereby the brackets 26 and 27 are swingably supported on the rod member 18 with the flange portions 29 directed toward each other.

In the illustrated example, the seat assembly 3 includes an interior panel member 31 of plywood or the like and having upper and lower surfaces 32 and 33 and respective front, rear and opposite end margins joined to form respective front and rear corners. A rear margin 35 of the seat panel member 31 is received within the frame 4 and extends generally between the spaced end members 9 and 10 whereby the seat assembly 3 folds into the frame 4 when in a retracted position, FIG. 3. In the illustrated example, the seat panel member 31 is affixed to the seat support brackets 26 and 27 at opposite rear corners thereof so that the respective flange portions 29 thereof contact the lower surface 33 and the arm portions 28 contact the rear portions of the end margins 36 and 37 adjacent the rear margins 35 or at the rear corners. The panel member 31 is secured to the flange portions 29 as by fasteners 39 extending through the flange portions 29 and into the panel member 31.

The spaced rear corners of the panel member 3 include an inlet portion 41 for a purpose later described.

Spaced stop members 43 and 44 are mounted to and extend upwardly from the frame lower member 12 and are respectively positioned adjacent the brackets 26 and 27. In the illustrated example, the stop members 43 and 44 respectively have a lower arm portion 45 extending generally between the front and rear margins 13 and 14 of the lower member 12 and suitably secured thereto as by fasteners 46. A leg portion 47 extends upwardly therefrom and an upper arm portion 48 affixed to the upper end of each leg portions 47 projects a short distance therefrom sufficient to provide an overhanging catch for engagement of a rear portion of the flange portions 29 of the seat support brackets 46 when the seat panel member 3 is swung downwardly into an extended position, thereby resisting further downward swinging movement and providing a stop therefor. The inlet portions 41 of the rear corners of the panel member 31 insure that the panel member 31 and cushions and the like thereon, described below, do not contact the stop members 43 and 44 and instead permit direct contact between the stop members 43 and 44 and the brackets 26 and 27. Preferably, the stop members 43 and 44 and the seat support bracket 26 and 27 are of a material such as steel, aluminum or the like metal for solid, unyielding contact therebetween, FIG. 4.

Figure 2:
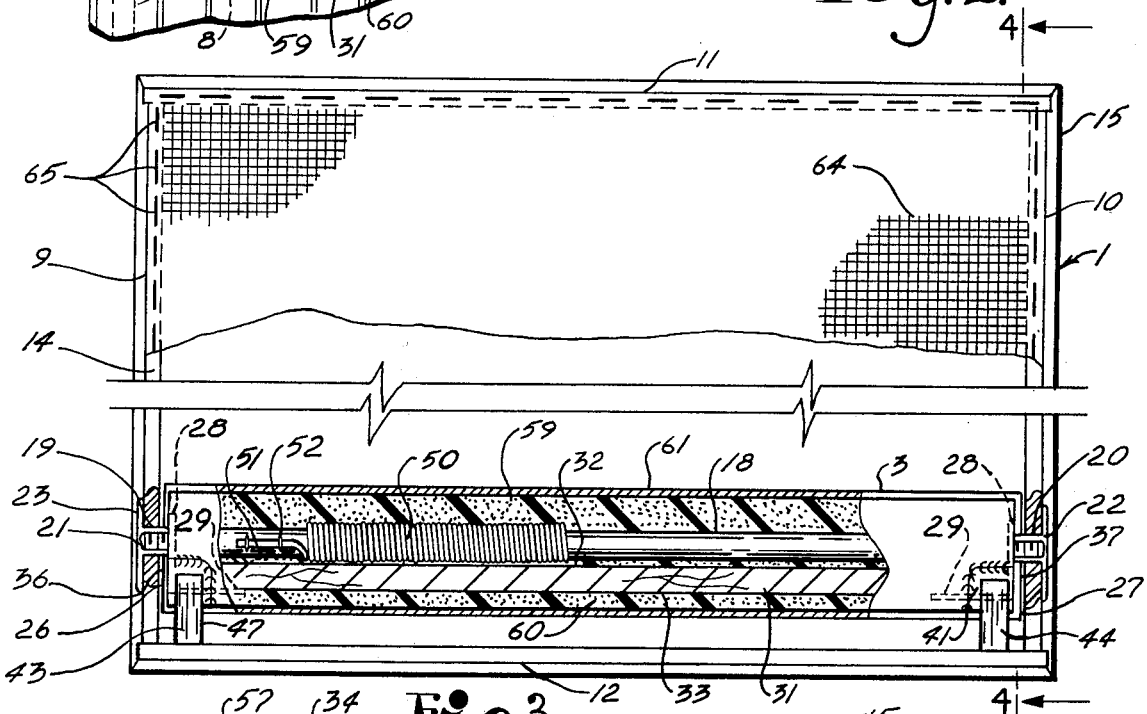
FIG. 2 is a rear elevational view of the retractable seat structure and having portions thereof broken away to reveal inner details.
Figure 3:
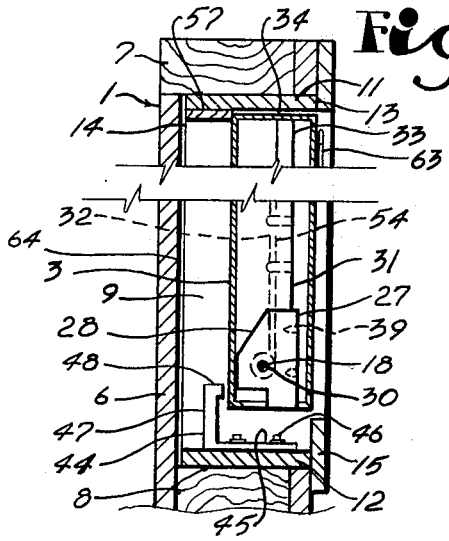
FIG. 3 is an end sectional view of the retractable seat structure showing a seat assembly thereof in a folded or retracted position.
Figure 4:
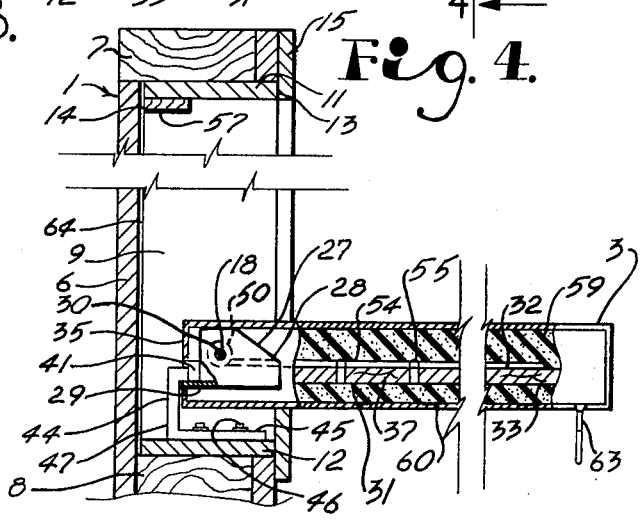
FIG. 4 is a cross-sectional view taken along lines 4—4, FIG. 2 and showing the seat assembly thereof in an extended position.

A resilient means is engaged with and cooperates with the pivot means, such as the rod member 18, and is operable in coordination with the weight of the seat assembly 3 to maintain the seat assembly in a retracted position, FIG. 3 as selected, or in an extended position, FIG. 4, as selected. In the illustrated example, a coil spring member 50 is sleeved on the rod member 18 and has a first end portion 51, FIG. 2, affixed to the rod member 18 in nonrotatable relationship therewith, as by fasteners 52. A second end portion 54 extends generally laterally outwardly from body portions of the coil spring member 50 and from the rod member 18 and is affixed to a surface of the panel member 31, such as the upper surface 32 as by fasteners 55. In the illustrated example, the rod member 18 is situated generally above the panel member 31 when the latter is in the extended position, FIG. 4 and accordingly, the coil spring member 50 is situated above the panel member 3 whereby the second end portion 4 is secured to the upper surface 32. The coil spring member 50 is secured in relative rotational position on the rod member 18 whereby the coil spring member is in an "at rest" relationship when the seat assembly 3 is in the retracted position. As the seat assembly 3 is swung downwardly, the second end portion 54 rotates with the seat assembly 3 and relative to the body of the coil spring member 18 to cause the same to be torsionally resilient and biased toward the "at rest" or retracted position.

The coil spring member 50 is of a torsion resistant or resiliently responsive strength relative to the weight of the seat assembly 3 whereby the strength of the coil spring member 50 is insufficient to raise the seat assembly 3 from an extended position without external aid, such as manual push and whereby the seat assembly 3 when folded upwardly into the retracted position, FIG. 3, remains in the retracted position and when swung downwardly into the extended position, FIG. 4, remains in the extended position. Because, in the illustrated example, the seat assembly 3 is rotatable relative to the rod member 18, and the spring second end portion 54 is affixed to the panel member 31, movement of the seat assembly 3 from a retracted position to an extended position causes a resilient, or biasing upward force in the coil spring member 50, which tends to rotate the seat assembly 3 upwardly. However, when the seat assembly 3 is swung downwardly and into the extended position, the downward weight of the seat assembly 3 is sufficient to overcome the resilient and upwardly biasing force of the coil spring member 50 and thereby the seat assembly 3 is maintained in the extended position. However, when the seat assembly 3 is in the retracted position, the weight thereof is generally positioned above and aligned with the pivotal means, such as the rod member 18, whereby the weight of the seat assembly 3 does not tend to counteract the resilient force of the coil spring member 50, thereby aiding the spring member 50 to maintain the seat assembly 3 in the retracted position.

An upper stop member 57 extends along a lower surface of the frame upper member 11 and provides an abuttment for contact with the seat assembly 3 when the latter is in the retracted position. In the illustrated example, the seat assembly 3 has a thick seating cushion 59, such as of upholstering foam, batting or the like, affixed to the panel member upper surface 32. A second cushion 60 covers the panel member lower surface 33, such as for decorative effect, and is visible when the seat is in the retracted position. A cover 61, such as of cloth or the like, covers the cushion 59 and 60 and the seat panel member 31 to provide comfortable seating and an attractive, ornamental appearance and may have various decorative and ornamental features of the upholsterer's art, such as buttons 62, FIG. 1, applied thereto.

A pull 63 is affixed to the seat assembly 3, such as at an upper front portion thereof, for grasping to swing the seat assembly 3 downward in an extended position. The pull 63 may be a strap handle, knob or the like and in the illustrated example, is a ring with a shank thereof extending through the second cushion 60 and into the panel member 31.

Preferably, a back cover 64 extends over the rear margins 14 of the frame 4 and is affixed thereto, such as by staples 65, to provide a suitable ornamental backing visible from the front, FIG. 1.

In use, the frame 4 of the retractable seat structure 1 is mounted within a building wall 2 as described above to provide a seating structure in hallways, corridors, waiting rooms and the like where seating space is often at a premium and where it is desired to have an interior of open and uncluttered appearance yet one which can be used for seating purposes. When not in use, the seat panel member 3 is folded upwardly into the retracted position whereby the seat structure 1 provides an unobtrusive appearance. When it is desired to utilize the seat structure 1 for seating purposes, the pull 63 is grasped and pulled upon to swing the seat assembly 3 downwardly into the extended position. Pulling force is required to overcome the resistance of the coil spring member 50 as the seat assembly 3 is moved from the retracted position, however, once the seat assembly 3 is in the extended position, the seat assembly tends to remain there until upward swinging force is exerted to move the seat assembly 3 back into the retracted position.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A retractable seat structure for movement between an open, extended position and a folded, retracted position and comprising:

(a) a frame for mounting within a wall and having spaced, upright end members and upper and lower members;

(b) an elongate rod member extending across said frame and having opposite ends secured to said spaced end members and positioned above said lower member;

(c) spaced seat support brackets respectively including arm portions and flange portions extending normally from said arm portions, said arm portions having apertures with said rod members extending therethrough whereby said brackets are swingably suspended from said rod member;

(d) a seat assembly having a seat panel member with upper and lower surfaces and front, rear and opposite end margins forming front and rear corner portions, the panel member being secured to said brackets and swingable therewith with said rear corner portions received in respective said brackets and said flange portion secured to said lower surface; the upper surface having a cushion covering providing a seating surface;

(e) spaced stop members for limiting swinging movement of said seat assembly relative to said frame and mounted on said frame lower member respectively adjacent said brackets and having leg portions extending upwardly and outwardly extending arm portions positioned to engage said bracket flange portions whereby said stop members prevent further downward swinging of said seat panel member when said seat assembly is in an open, extended position; and (f) a coil spring member sleeved on said rod member and having a first end portion non-rotatably affixed to said rod member and a second end portion extending laterally outward from said rod member and affixed to a surface of said panel member; the coil spring being torsionally responsive to relative movement between said seat assembly and said frame and of a torsional strength relative to the weight of said seat assembly whereby said seat assembly, when folded upwardly into a retracted position, remains in said retracted position and, when swung downwardly into said extended position, remains in said extended position.

2. A retractable seat structure for movement between an open, extended position and a folded, retracted position and comprising:

(a) a frame for mounting within a wall and having spaced, upright end members and upper and lower members;

(b) a seat panel having a upper surface, a lower surface, front and rear portions, and spaced rear corners;

(c) an elongate rod member extending between and mounted to said spaced end members;

(d) spaced seat support brackets respectively having arm portions with apertures therethrough for receipt of said rod member and flange portions secured to said seat panel at said rear corners;

(e) spaced stop members secured to said frame lower member and respectively having upstanding leg portions and outwardly extending arm portions with said arm portions engageable with said bracket flange portions when said seat panel rotates to an open, extended position to provide a stop therefor; and (f) a coil spring sleeved on said rod member and torsionally responsive to relative movement between said seat panel and said frame; said spring exerting a force on said seat panel less than the pull of gravity thereon when said seat panel is in said extended position and exerting an upward force on said seat panel greater than the pull of gravity when said seat panel is in said retracted position.

3. The seat structure set forth in claim 2 wherein:

(a) said coil spring includes first and second end portions, said first end portion being secured to said rod member and said second end portion secured to one of said upper and lower surfaces whereby said coil spring is torsionally resilient upon rotation of said panel member relative to said rod member.

4. The seat structure set forth in claim 2 wherein:

(a) the upper surface of said seat panel has a cushion affixed thereto and providing a seating surface and said cushion and said seat panel lower surface have a fabric covering thereon; and (b) said cushion has inlet portions at the rear corners exposing said bracket flange portions for engagement with said stop members.

* * * * *